US011587502B2

(12) United States Patent
Jeong

(10) Patent No.: US 11,587,502 B2
(45) Date of Patent: Feb. 21, 2023

(54) PIXEL AND METHOD FOR DRIVING PIXEL

(71) Applicant: SAMSUNG DISPLAY CO., LTD., Yongin-si (KR)

(72) Inventor: Il Hun Jeong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/602,466

(22) PCT Filed: Feb. 20, 2020

(86) PCT No.: PCT/KR2020/095008

§ 371 (c)(1),
(2) Date: Oct. 8, 2021

(87) PCT Pub. No.: WO2020/231241

PCT Pub. Date: Nov. 19, 2020

(65) Prior Publication Data

US 2022/0208084 A1 Jun. 30, 2022

(30) Foreign Application Priority Data

May 16, 2019 (KR) ..... 10-2019-0057346

(51) Int. Cl.
*G09G 3/32* (2016.01)

(52) U.S. Cl.
CPC ..... *G09G 3/32* (2013.01); *G09G 2310/0262* (2013.01); *G09G 2320/043* (2013.01); *G09G 2330/021* (2013.01)

(58) Field of Classification Search
CPC ..... G09G 3/32; G09G 3/3233; G09G 3/325; G09G 3/3258; G09G 2310/0262;
(Continued)

(56) References Cited

U.S. PATENT DOCUMENTS 7,180,486 B2 2/2007 Jeong
8,054,258 B2 11/2011 Choi et al.
(Continued)

FOREIGN PATENT DOCUMENTS

KR 100673759 B1 1/2007
KR 100844770 B1 7/2008
(Continued)

OTHER PUBLICATIONS

International Search Report dated Jun. 4, 2020 for PCT/KR2020/095008.
(Continued)

*Primary Examiner* — Vijay Shankar
(74) *Attorney, Agent, or Firm* — Cantor Colburn LLP

(57) ABSTRACT

A pixel according to the present disclosure includes a light emitting diode including an anode coupled to a first node; a first capacitor including a first electrode coupled to the first node, and a second electrode coupled to a second node; a first transistor including a gate electrode coupled to the second node, a first electrode coupled to a third node, and a second electrode coupled to a fourth node; and a second transistor including a gate electrode coupled to a first scan line, a first electrode coupled to a data line, and a second electrode coupled to the third node.

20 Claims, 21 Drawing Sheets

(58) Field of Classification Search
CPC ..... G09G 2320/043; G09G 2330/021; G09G 3/3266; G09G 2300/0819; G09G 2300/0852; G09G 2300/0861; G09G 2310/0251
See application file for complete search history.

(56) References Cited

U.S. PATENT DOCUMENTS

| | | | | |
|---|---|---|---|---|
| 8,786,591 | B2 | 7/2014 | Park et al. | |
| 9,823,729 | B2 * | 11/2017 | An | G09G 3/3233 |
| 10,062,321 | B2 | 8/2018 | Na et al. | |
| 10,403,704 | B2 | 9/2019 | Chae | |
| 10,551,903 | B2 * | 2/2020 | An | G06F 1/3265 |
| 10,650,739 | B2 * | 5/2020 | Kim | H01L 27/3276 |
| 10,762,851 | B2 | 9/2020 | Kwon et al. | |
| 2008/0211397 | A1 | 9/2008 | Choi | |
| 2009/0225011 | A1 | 9/2009 | Choi | |
| 2016/0124491 | A1 | 5/2016 | An et al. | |
| 2017/0148865 | A1 | 5/2017 | Cho et al. | |
| 2018/0286307 | A1 | 10/2018 | Kim et al. | |

FOREIGN PATENT DOCUMENTS

| | | | |
|---|---|---|---|
| KR | 1020160052942 | A | 5/2016 |
| KR | 101760090 | B1 | 7/2017 |
| KR | 1020170090559 | A | 8/2017 |
| KR | 1020190010058 | A | 1/2019 |
| KR | 1020190034376 | A | 4/2019 |
| KR | 1020200130546 | A | 11/2020 |

OTHER PUBLICATIONS

Written Opinion of the International Searching Authority for PCT/KR2020/095008 dated Jun. 4, 2020.

* cited by examiner

PIXEL AND METHOD FOR DRIVING PIXEL

TECHNICAL FIELD

Various embodiments of the present disclosure relate to a pixel and a method of driving the pixel.

BACKGROUND ART

With the development of information technology, the importance of a display device that is a connection medium between a user and information has been emphasized. Owing to the importance of the display device, the use of various display devices such as a liquid crystal display device, an organic light emitting display device, and a plasma display device has increased.

Each pixel of the display device may include at least one light emitting diode. The light emitting diode may deteriorate as the period of use increases. The deteriorated light emitting diode may require more driving current to exhibit the same luminance.

DISCLOSURE

Technical Problem

An object to be solved is to provide a pixel and a method of driving the pixel that are capable of self-compensating for the degradation of a light emitting diode.

Further, an object to be solved is to provide a pixel and a method of driving the pixel that are capable of improving black expression, enabling low-frequency driving, and reducing power consumption by reducing a leakage current.

Technical Solution

A pixel according to an embodiment of the present disclosure includes a light emitting diode including an anode coupled to a first node; a first capacitor including a first electrode coupled to the first node, and a second electrode coupled to a second node; a first transistor including a gate electrode coupled to the second node, a first electrode coupled to a third node, and a second electrode coupled to a fourth node; and a second transistor including a gate electrode coupled to a first scan line, a first electrode coupled to a data line, and a second electrode coupled to the third node.

The pixel may further include a third transistor including a gate electrode coupled to a second scan line, a first electrode coupled to an initialization line, and a second electrode coupled to the first node.

The pixel may further include a fourth transistor including a gate electrode coupled to an emission line, a first electrode coupled to the fourth node, and a second electrode coupled to the first node.

The pixel may further include a fifth transistor including a gate electrode coupled to the emission line, a first electrode coupled to a first power line, and a second electrode coupled to the third node.

The pixel may further include a sixth transistor including a gate electrode coupled to a third scan line, a first electrode coupled to the fourth node, and a second electrode coupled to the initialization line.

The pixel may further include a seventh transistor including a gate electrode coupled to the first scan line, a first electrode coupled to the second node, and a second electrode coupled to the fourth node.

The pixel may further include a second capacitor including a first electrode coupled to the first power line, and a second electrode coupled to the second node.

The pixel may further include an eighth transistor including a gate electrode coupled to the third scan line, a first electrode coupled to the second node, and a second electrode coupled to the fourth node.

The pixel may further include a seventh transistor including a gate electrode coupled to the first scan line, a first electrode, and a second electrode coupled to the fourth node; and an eighth transistor including a gate electrode coupled to the first scan line, a first electrode coupled to the first electrode of the seventh transistor, and a second electrode coupled to the second node.

The pixel may further include a second capacitor including a first electrode coupled to the first power line, and a second electrode coupled to the second node.

The pixel may further include a sixth transistor including a gate electrode coupled to the first scan line, a first electrode coupled to the initialization line, and a second electrode coupled to the fourth node.

The pixel may further include a seventh transistor including a gate electrode coupled to the first scan line, a first electrode coupled to the second node, and a second electrode coupled to the initialization line; and an eighth transistor including a gate electrode coupled to the third scan line, a first electrode coupled to the second node, and a second electrode coupled to the initialization line.

The pixel may further include a sixth transistor including a gate electrode coupled to a third scan line, a first electrode, and a second electrode coupled to the initialization line; a seventh transistor including a gate electrode coupled to the first scan line, a first electrode coupled to the second node, and a second electrode coupled to the first electrode of the sixth transistor; and an eighth transistor including a gate electrode coupled to the first scan line, a first electrode coupled to the first electrode of the sixth transistor, and a second electrode coupled to the fourth node.

The pixel may further include a second capacitor including a first electrode coupled to the first power line, and a second electrode coupled to the second node.

In a driving method of a pixel including a light emitting diode including an anode coupled to a first node; a first capacitor including a first electrode coupled to the first node, and a second electrode coupled to a second node; a first transistor including a gate electrode coupled to the second node, a first electrode coupled to a third node, and a second electrode coupled to a fourth node; a second transistor including a gate electrode coupled to a first scan line, a first electrode coupled to a data line, and a second electrode coupled to the third node, a third transistor including a gate electrode coupled to a second scan line, a first electrode coupled to the initialization line, and a second electrode coupled to the first node, a fourth transistor including a gate electrode coupled to an emission line, a first electrode coupled to the fourth node, and a second electrode coupled to the first node; and a fifth transistor including a gate electrode coupled to the emission line, a first electrode coupled to a first power line, and a second electrode coupled to the third node, the method includes electrically connecting the second node to an initialization line, and turning on the second transistor; electrically disconnecting the second node from the initialization line in a state in which the second transistor is turned on; turning off the second transistor; and electrically connecting the first node to the initialization line in a state in which the second transistor is turned off.

In the electrical connecting of the first node to the initialization line, third transistor may be turned on.

The method may further include turning off the third transistor; and turning on the fourth transistor and the fifth transistor in a state in which the third transistor is turned off.

A driving method of a pixel including a light emitting diode including an anode coupled to a first node; a first capacitor including a first electrode coupled to the first node, and a second electrode coupled to a second node; a first transistor including a gate electrode coupled to the second node, a first electrode coupled to a third node, and a second electrode coupled to a fourth node; and a second transistor including a gate electrode coupled to a first scan line, a first electrode coupled to a data line, and a second electrode coupled to the third node, a third transistor including a gate electrode coupled to a second scan line, a first electrode coupled to the initialization line, and a second electrode coupled to the first node, a fourth transistor including a gate electrode coupled to an emission line, a first electrode coupled to the fourth node, and a second electrode coupled to the first node; and a fifth transistor including a gate electrode coupled to the emission line, a first electrode coupled to a first power line, and a second electrode coupled to the third node, the method includes electrically connecting the second node to the initialization line in a state in which the second transistor is turned off; electrically disconnecting the second node from the initialization line; turning on the second transistor in a state in which the second node is electrically disconnected from the initialization line, turning off the second transistor; and electrically connecting the first node to the initialization line in a state in which the second transistor is turned off.

In the electrical coupling of the first node to the initialization line, third transistor may be turned on.

The method may further include turning off the third transistor; and turning on the fourth transistor and the fifth transistor in a state in which the third transistor is turned off.

Advantageous Effects

A pixel and a method of driving the pixel according to the present disclosure can self-compensate for the degradation of a light emitting diode.

Furthermore, a pixel and a method of driving the pixel according to the present disclosure can improve black expression, enable low-frequency driving, and reduce power consumption by reducing a leakage current.

MODE FOR INVENTION

Figure 1:
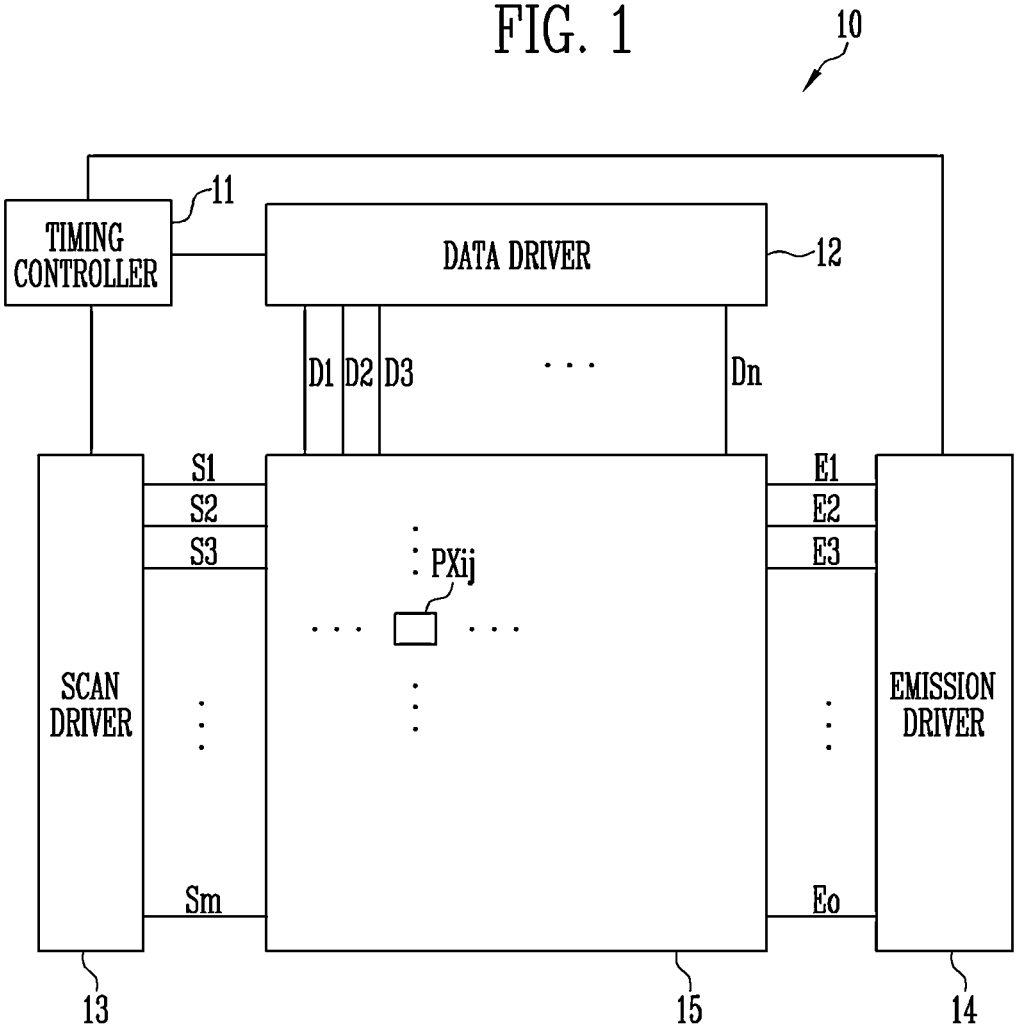
FIG. 1 is a diagram illustrating a display device according to an embodiment of the present disclosure.

Hereinafter, embodiments of the present disclosure will be described in detail with reference to the attached drawings, such that those skilled in the art can easily implement the present disclosure. The present disclosure may be embodied in various different forms without being limited to embodiments to be described herein.

In the drawings, portions which are not related to the present disclosure will be omitted to explain the present disclosure more clearly. Reference should be made to the drawings, in which similar reference numerals are used throughout the different drawings to designate similar components. Therefore, the aforementioned reference numerals may be used in other drawings.

For reference, the size of each component and the thicknesses of lines illustrating the component are arbitrarily expressed for the sake of explanation, and the present disclosure is not limited to those illustrated in the drawings. In the drawings, the thicknesses of the components may be exaggerated to clearly express several layers and areas.

Figure 2:
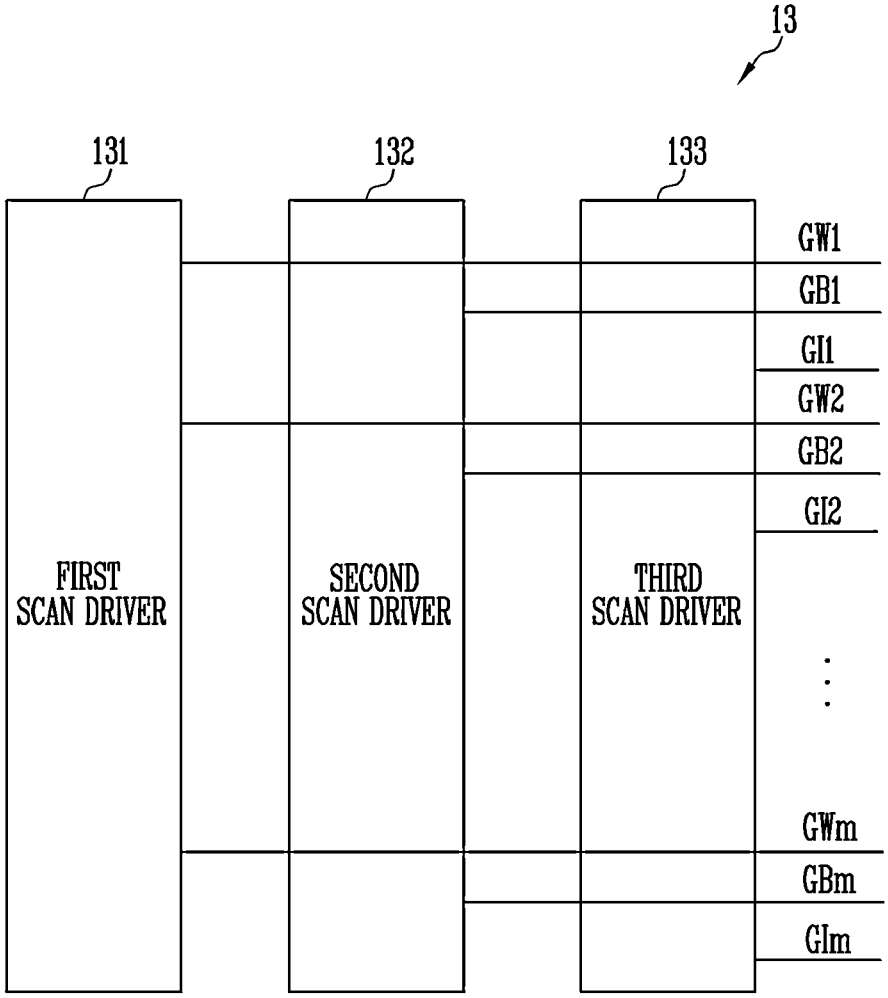
FIG. 2 is a diagram illustrating a scan driver according to an embodiment of the present disclosure.

FIG. 1 is a diagram illustrating a display device according to an embodiment of the present disclosure, and FIG. 2 is a diagram illustrating a scan driver according to an embodiment of the present disclosure.

Referring to FIG. 1, the display device 10 according to an embodiment of the present disclosure may include a timing controller 11, a data driver 12, a scan driver 13, an emission driver 14, and a pixel circuit 15.

The timing controller 11 may receive gray scale values and control signals for an image frame from an external processor. The timing controller 11 may render the gray scale values in response to specifications of the display device 10. For example, the external processor may provide a red gray-scale value, a green gray-scale value, and a blue gray-scale value for each unit dot. However, for example, in the case where the pixel circuit 15 has a pentile structure, because adjacent unit dots may share a pixel, the pixels may not one-to-one correspond to the respective gray scale values. In this case, there is a need to render the gray scale values. If the pixels one-to-one correspond to the respective gray scale values, the operation of rendering the gray scale values may not be required. Gray scale values that have been rendered or have not been rendered may be provided to the data driver 12. Furthermore, the timing controller 11 may provide, to the data driver 12, the scan driver 13, the emission driver 14, etc., control signals suitable for specifications of the respective components to express image frames.

The data driver 12 may generate data voltages to be provided to data lines D1, D2, D3, and, Dn using the gray scale values and the control signals. For example, the data driver 12 may sample the gray scale values using a clock signal, and apply data voltages corresponding to the gray scale values to the data lines D1 to Dn on a pixel row basis. Here, n may be an integer greater than 0.

The scan driver 13 may receive a clock signal, a scan start signal, etc. from the timing controller 11, and generate scan signals to be provided to the scan lines S1, S2, S3, and, Sm. Here, m may be an integer greater than 0.

Referring further to FIG. 2, the scan lines S1 to Sm may include first scan lines GW1, GW2, and, GWm, second scan lines GB1, GB2, and, GBm, and third scan lines GI1, GI2, and, GIm.

In an embodiment, the scan driver 13 may include a first scan driver 131 configured to sequentially supply first scan signals each having a turn-on level pulse to the first scan lines GW1, GW2, and, GWm, a second scan driver 132 configured to sequentially supply second scan signals each having a turn-on level pulse to the second scan lines GB1, GB2, and, GBm, and a third scan driver 133 configured to sequentially supply third scan signals each having a turn-on level pulse to the third scan lines GI1, GI2, and, GIm. Each of the first to third scan drivers 131, 132, and 133 may include scan stage circuits configured in the form of shift registers. The first to third scan drivers 131, 132, and 133 each may generate scan signals by sequentially transmitting a scan start signal having a turn-on level pulse shape to a subsequent stage circuit under the control of a clock signal.

In an embodiment, depending on a method of driving the pixel, at least some of the first to third scan drivers 131, 132, and 133 may be integrally formed. For example, as in the driving method of FIG. 4, when the turn-on level pulses of the second and third scan signals are equal in length and different only in phase, the second scan driver 132 and the third scan driver 133 may be integrally formed. Meanwhile, as in the driving method of FIG. 15, when the turn-on level pulses of the first to third scan signals are equal in length and different only in phase, the first to third scan drivers 131, 132, and 133 may be integrally formed.

The emission driver 14 may receive a clock signal, an emission stop signal, etc. from the timing controller 11, and generate emission signals to be provided to emission lines E1, E2, E3, and, Eo. For example, the emission driver 14 may sequentially provide emission signals each having a turn-off level pulse to the emission lines E1 to Eo. For example, each emission stage circuit of the emission driver 14 may be made in the form of the shift register, and may generate emission signals in such a way as to sequentially transmit the emission stop signal in the form of a turn-off level pulse to a next emission stage circuit under the control of the clock signal. o may be an integer greater than 0.

The pixel circuit 15 includes pixels. Each pixel PXij may be coupled to a corresponding data line, a corresponding scan line, and a corresponding emission line. In this application, except for using with the expression of "through an object", "coupled to" may means "directly connected". Further, the pixels PXij may be coupled to common first and second power lines. Here, i and j may be natural numbers. The pixel PXij may refer to a pixel, a scan transistor of which is coupled to an i-th scan line and a j-th data line.

Figure 3:
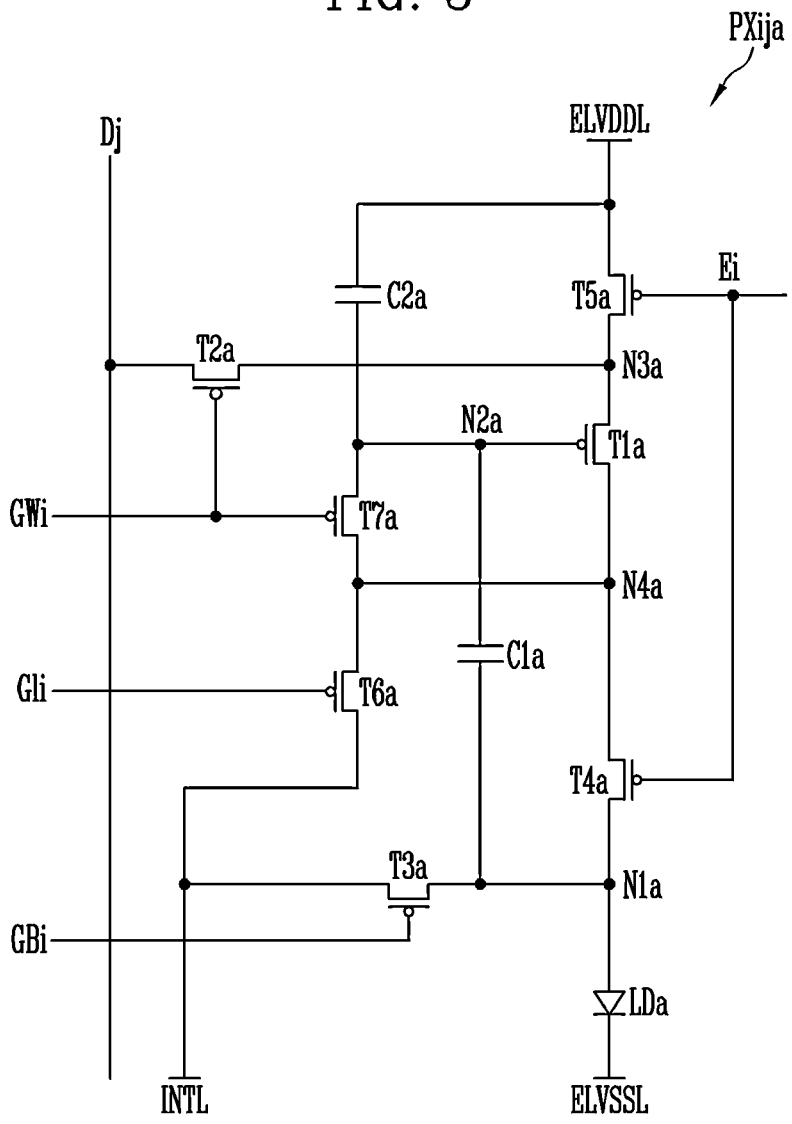
FIG. 3 is a diagram illustrating a pixel according to a first embodiment of the present disclosure.

FIG. 3 is a diagram illustrating a pixel according to a first embodiment of the present disclosure.

Referring to FIG. 3, the pixel PXija according to the first embodiment of the present disclosure includes transistors T1*a* to T7*a*, capacitors C1*a* and C2*a*, and a light emitting diode LDa.

In this embodiment, although the transistors are illustrated as a P-type transistor (e.g., PMOS), those skilled in the art may form the pixel circuit having the same function as an N-type transistor (e.g., NMOS) in another embodiment. Further, those skilled in the art may form the pixel circuit having the same function by combining the P-type transistor and the N-type transistor in still another embodiment. Hereinafter, it is assumed that the transistors are formed of the P-type transistors.

The light emitting diode LDa may include an anode coupled to a first node N1*a*, and a cathode coupled to a second power line ELVSSL. The light emitting diode LDa may be an organic light emitting diode, an inorganic light emitting diode, a quantum dot light emitting diode, etc. Further, it is illustrated in this embodiment that the pixel PXija includes one light emitting diode LDa, but it is illustrated. In another embodiment, the pixel PXija may include two or more light emitting diodes LDa. In this case, the two or more light emitting diodes LDa may be coupled to each other in parallel or in series. In the following embodiments, it is assumed that the pixel includes one light emitting diode.

The first capacitor C1*a* may include a first electrode coupled to the first node N1*a*, and a second electrode coupled to a second node N2*a*.

A first transistor T1*a* may include a gate electrode coupled to the second node N2*a*, a first electrode coupled to a third node N3*a*, and a second electrode coupled to a fourth node N4*a*. The first transistor T1*a* may be referred to as a "driving transistor."

A second transistor T2*a* may include a gate electrode coupled to a first scan line GWi, a first electrode coupled to a data line Dj, and a second electrode coupled to the third node N3*a*. The second transistor T2*a* may be referred to as a "scan transistor" or a "switching transistor."

A third transistor T3*a* may include a gate electrode coupled to a second scan line GBi, a first electrode coupled to an initialization line INTL, and a second electrode coupled to the first node N1*a*. The third transistor T3*a* may be referred to as an "anode initialization transistor."

A fourth transistor T4*a* may include a gate electrode coupled to the emission line Ei, a first electrode coupled to the fourth node N4*a*, and a second electrode coupled to the first node N1*a*. The fourth transistor T4*a* may be referred to as an "emission transistor."

A fifth transistor T5*a* may include a gate electrode coupled to the emission line Ei, a first electrode coupled to a first power line ELVDDL, and a second electrode coupled to the third node N3*a*. The fifth transistor T5*a* may be referred to as an "emission transistor." It is illustrated in FIG. 3 that the same emission line Ei is coupled to the gate electrodes of the fourth transistor T4*a* and the fifth transistor T5*a*. However, according to another embodiment, different emission lines may be coupled to the gate electrodes of the fourth transistor T4*a* and the fifth transistor T5*a* from each other.

A sixth transistor T6*a* may include a gate electrode coupled to the third scan line GIi, a first electrode coupled to the fourth node N4*a*, and a second electrode coupled to the initialization line INTL. The sixth transistor T6*a* may be referred to as a "gate initialization transistor."

A seventh transistor T7*a* may include a gate electrode coupled to the first scan line GWi, a first electrode coupled to the second node N2*a*, and a second electrode coupled to the fourth node N4*a*. The seventh transistor T7*a* may be referred to as a "diode connection transistor."

The second capacitor C2*a* may include a first electrode coupled to the first power line ELVDDL, and a second electrode coupled to the second node N2*a*.

A first supply voltage may be applied to the first power line ELVDDL. A second supply voltage may be applied to the second power line ELVSSL. The magnitude of the first supply voltage and the magnitude of the second supply voltage may vary depending on the driving method. For example, in an emission period P14 of the pixel PXija (see FIG. 10), the magnitude of the first supply voltage may be greater than the magnitude of the second supply voltage. Hereinafter, a duplicated description of the magnitudes of the first supply voltage and the second supply voltage will be omitted.

An initialization voltage may be applied to the initialization line INTL. The magnitude of the initialization voltage may vary depending on the driving method. For example, the magnitude of the initialization voltage in a gate initialization period P11 (see FIG. 4) of the pixel PXija may be sufficiently small so that the first transistor T1*a* is turned on in at least a portion of a threshold voltage compensation period P12 (see FIG. 6) of the pixel PXija. For example, the magnitude of the initialization voltage in the gate initialization period P11 (see FIG. 4) of the pixel PXija may be smaller than data voltage DTij (see FIG. 6) supplied to the threshold voltage compensation period P12 (see FIG. 6) of the pixel PXija. Further, for example, the magnitude of the initialization voltage in the anode initialization period P13 (see FIG. 8) of the pixel PXija may be equal to or less than the magnitude of the second supply voltage. Meanwhile, the initialization voltage in the anode initialization period P13 (see FIG. 8) of the pixel PXija may be greater than the second supply voltage. However, in this case, the initialization voltage may be smaller than the sum of the emission threshold voltage of the light emitting diode LDa and the second supply voltage. Hereinafter, a duplicated description of the initialization voltage will be omitted.

FIGS. 4 to 11 are diagrams for describing an example of a method of driving the pixel of FIG. 2.

Figure 4:
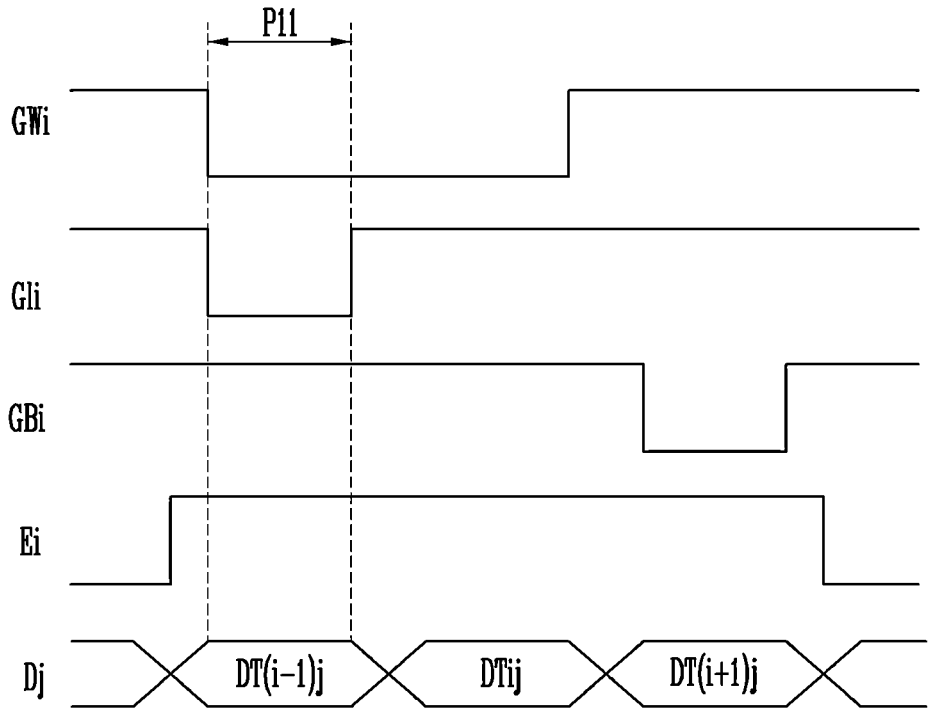
FIGS. 4 to 11 are diagrams for describing an example of a method of driving the pixel of FIG. 2.
Figure 5:
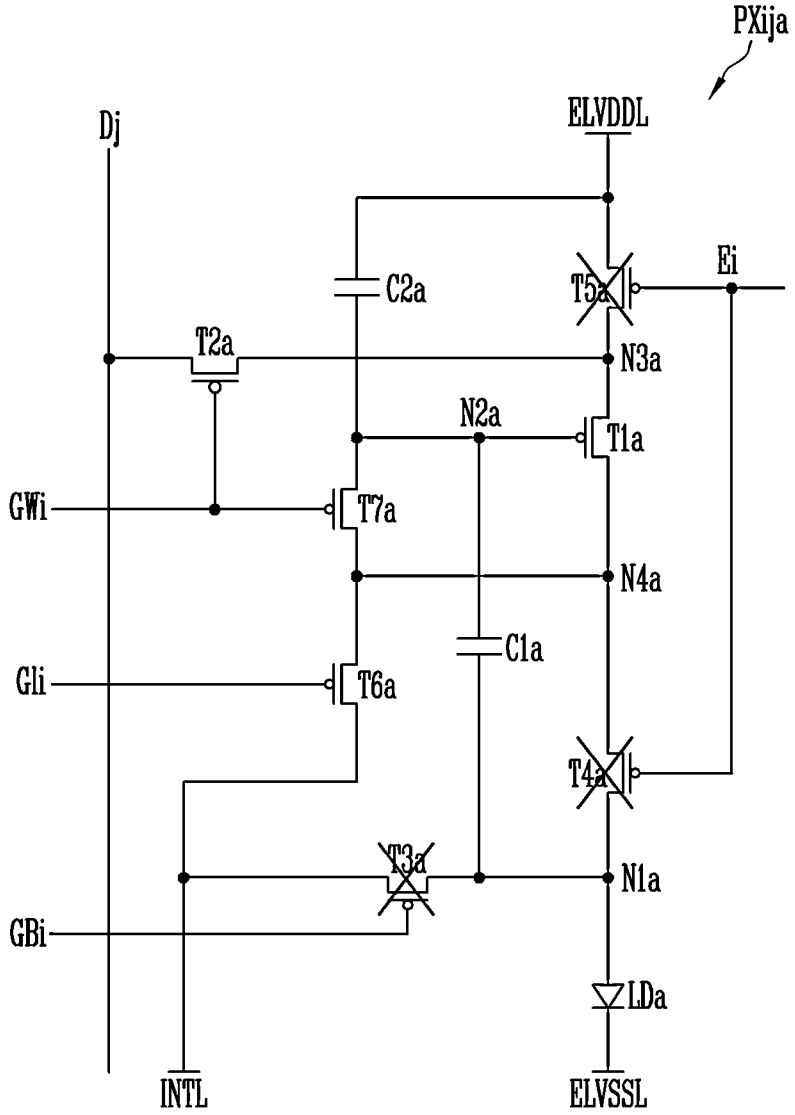

Referring to FIGS. 4 and 5, in the first period P11 (i.e., gate initialization period), a first scan signal having a turn-on level (e.g., a logic low level) may be applied to the first scan line GWi. In this case, a third scan signal having a turn-on level (e.g., a logic low level) may be applied to the third scan line GIi. In this case, a second scan signal having a turn-off level (e.g., a logic high level) may be applied to the second scan line GBi. In this case, an emission signal having a turn-off level may be applied to the emission line Ei. In this case, a data voltage DT(i−1)j for a previous pixel row may be applied to the data line Dj. The previous pixel row may mean pixels in which an i−1-th first scan line is coupled to the gate electrodes of the scan transistors.

Thus, in the first period P11, the transistors T1*a*, T2*a*, T6*a*, and T7*a* may be turned on, and the transistors T3*a*, T4*a*, and T5*a* may be turned off.

The data line Dj may be coupled to the second node N2*a* through the transistors T2*a*, T1*a*, and T7*a*. Further, the initialization line INTL may be coupled to the second node N2*a* through the transistors T6*a* and T7*a*. In this case, due to a difference in load between the data line Dj and the initialization line INTL, the voltage of the second node N2*a* may become the initialization voltage. The first period P11 may be referred to as the gate initialization period.

Figure 6:
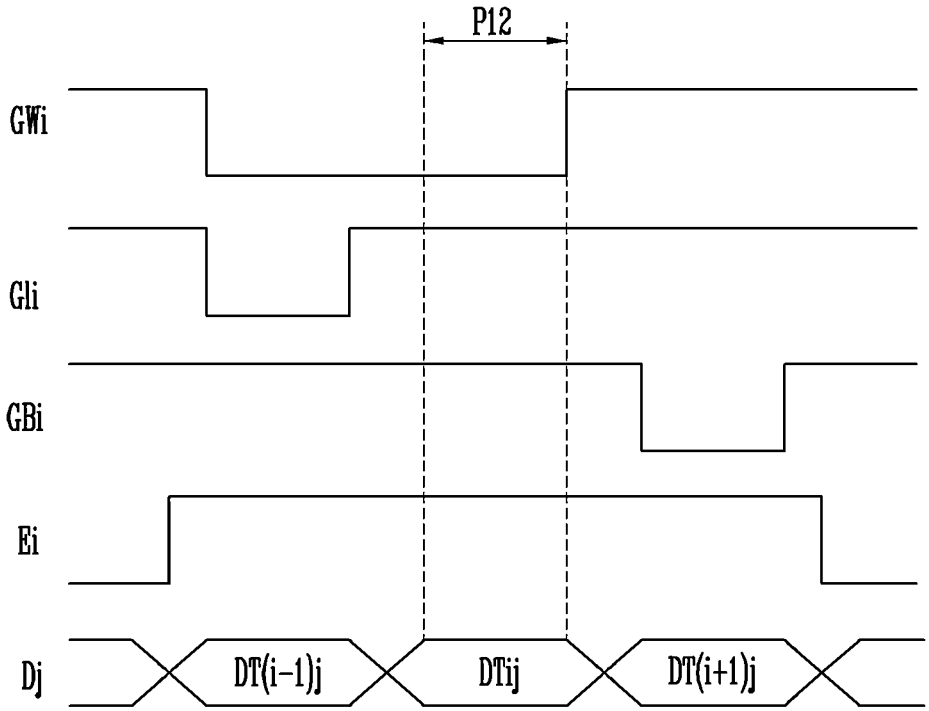
Figure 7:
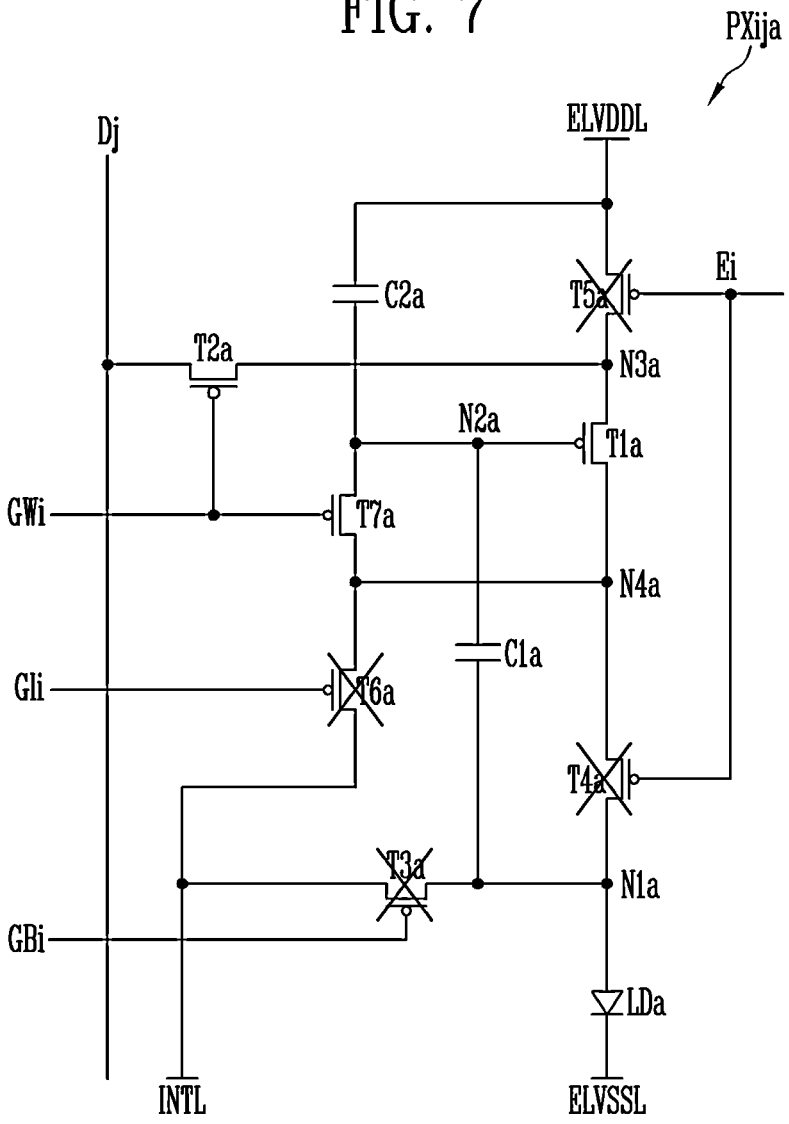

Referring to FIGS. 6 and 7, in a second period P12 (i.e., threshold voltage compensation period), a first scan signal having a turn-on level may be applied to the first scan line GWi. In this case, a third scan signal having a turn-off level may be applied to the third scan line GIi. In this case, a second scan signal having a turn-off level may be applied to the second scan line GBi. In this case, the emission signal having the turn-off level may be applied to the emission line Ei. In this case, the data voltage DTij for the pixel PXija may be applied to the data line Dj.

Thus, in the second period P12, the transistors T1*a*, T2*a*, and T7*a* may be turned on, and the transistors T3*a*, T4*a*, T5*a*, and T6*a* may be turned off.

The data line Dj may be coupled to the second node N2*a* through the transistors T2*a*, T1*a*, and T7*a*. Therefore, the voltage of the second node N2*a* may become a compensation voltage obtained by subtracting the threshold voltage of the first transistor T1*a* from the data voltage DTij as the following Equation 1.

$$VN2a=DTij-Vtrth \quad \text{[Equation 1]}$$

Here, VN2*a* represents the voltage of the second node N2*a*, DTij represents the data voltage, and Vtrth represents the threshold voltage of the first transistor T1*a*.

By a process deviation or degradation, threshold voltages of the first transistors T1*a* of the pixels PXija may be different from each other. Through the second period P12, the threshold voltages of the first transistors T1*a* which are different from each other may be individually compensated. The second period P12 may be referred to as the threshold voltage compensation period.

In the second period P12, the voltage of the first node N1*a* may be as the following Equation 2.

$$VN1a=ELVSS+Vldth \quad \text{[Equation 2]}$$

Here, VN1*a* represents the voltage of the first node N1*a*, ELVSS represents the voltage of the second power line ELVSSL, and Vldth represents the emission threshold voltage of the light emitting diode LDa.

At this point, the light emitting diode LDa is in a non-emission state because it is not supplied with a driving current, but is charged with the emission threshold voltage due to the driving current supplied from a previous frame.

By a process deviation or degradation, emission threshold voltages of the light emitting diodes LDa of the pixels PXija may be different from each other. The light emitting diode LDa may emit light after the emission threshold voltage is charged.

Figure 8:
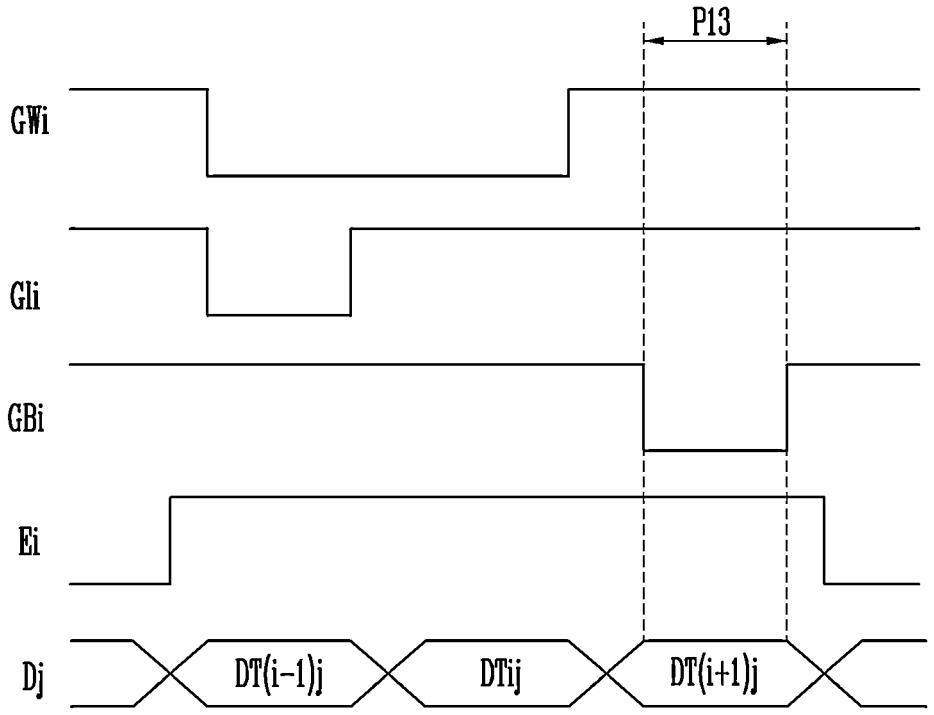
Figure 9:
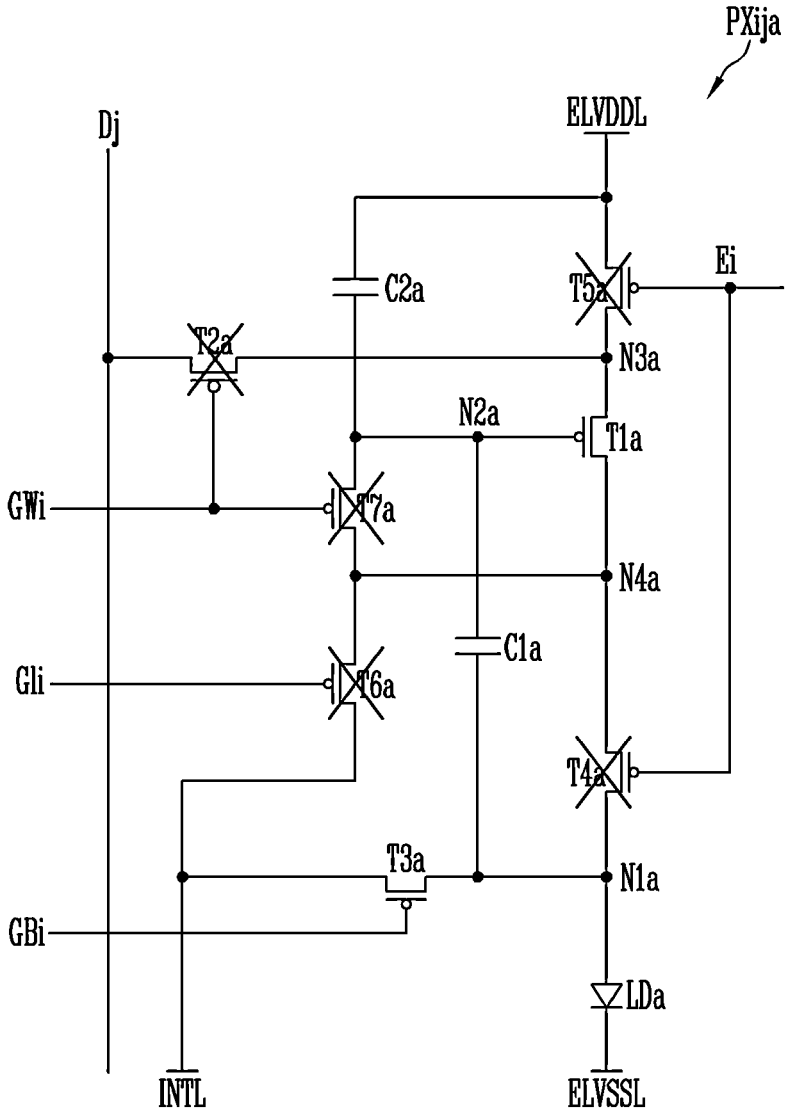

Referring to FIGS. 8 and 9, in a third period P13 (i.e., anode initialization period), the first scan signal having the turn-off level may be applied to the first scan line GWi. In this case, the third scan signal having the turn-off level may be applied to the third scan line GIi. In this case, the second scan signal having the turn-on level may be applied to the second scan line GBi. In this case, the emission signal having the turn-off level may be applied to the emission line Ei. In this case, the data voltage DT(i+1)j for a next pixel row may be applied to the data line Dj. The next pixel row may mean pixels in which an i+1-th first scan line is coupled to the gate electrodes of the scan transistors.

Thus, in the third period P13, the transistors T1*a* and T3*a* may be turned on, and the transistors T2*a*, T4*a*, T5*a*, T6*a*, and T7*a* may be turned off.

Since the first node N1*a* is coupled to the initialization line INTL through the third transistor T3*a*, the voltage of the first node N1*a* becomes the initialization voltage. In an embodiment, if the initialization voltage has the same magnitude as the second supply voltage, the voltage charged in the light emitting diode LDa is initialized to 0V. In another embodiment, if the initialization voltage is greater than the second supply voltage, the light emitting diode LDa may be pre-charged with a predetermined voltage. In still another embodiment, if the initialization voltage is smaller than the second supply voltage, a reverse bias voltage may be applied to the light emitting diode LDa, thus prolonging the lifetime of the light emitting diode LDa. The third period P13 may be referred to as the anode initialization period.

Here, the voltage variation of the first node N1a is as follows shown in Equation 3.

$$dVN1a=VINT-(ELVSS+Vldth) \quad \text{[Equation 3]}$$

Here, dVN1a represents the voltage variation of the first node N1a, VINT represents the initialization voltage of the initialization line INTL, ELVSS represents the voltage of the second power line ELVSSL, and Vldth represents the emission threshold voltage of the light emitting diode LDa.

In this case, the voltage of the second node N2a is changed based on the voltage variation of the first node N1a and the capacitance ratio of the first capacitor C1a and the second capacitor C2a as shown in Equation 4.

$$dVN2a = \frac{CC1a}{CC1a + CC2a} * dVN1a \quad \text{[Equation 4]}$$

Here, dVN2a represents the voltage variation of the second node N2a, CC1a represents the capacitance of the first capacitor C1a, CC2a represents the capacitance of the second capacitor C2a, and dVN1a represents the voltage variation of the first node N1a.

Thus, the voltage of the second node N2a may be expressed by the following Equation 5.

$$VN2a=DTij-Vtrth+dVN2a \quad \text{[Equation 5]}$$

Here, VN2a represents the voltage of the second node N2a, DTij represents the data voltage DTij, Vtrth represents the threshold voltage of the first transistor T1a, and dVN2a represents the voltage variation of the second node N2a.

Figure 10:
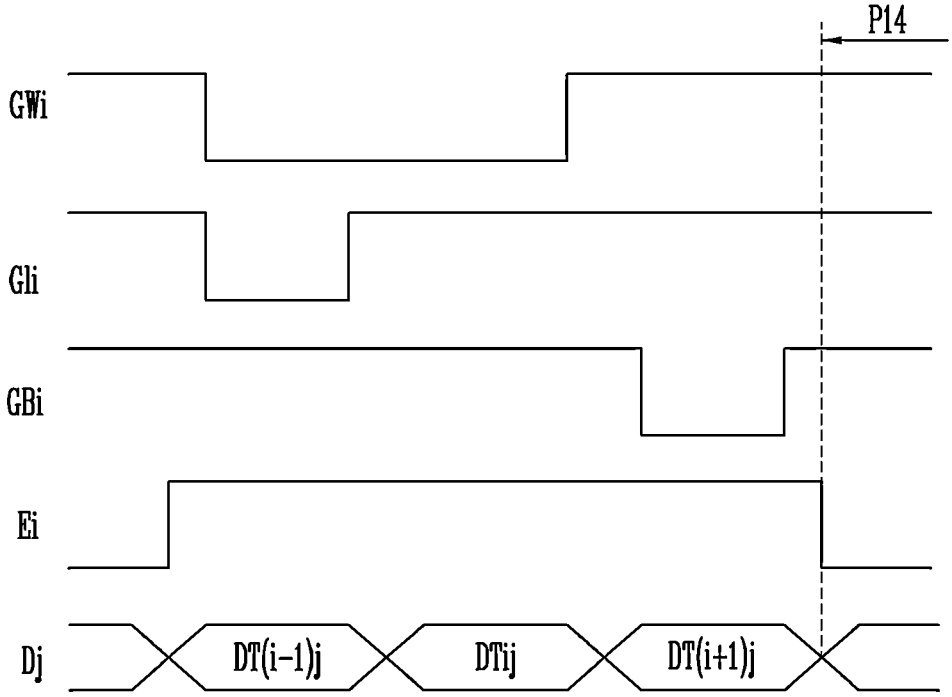
Figure 11:
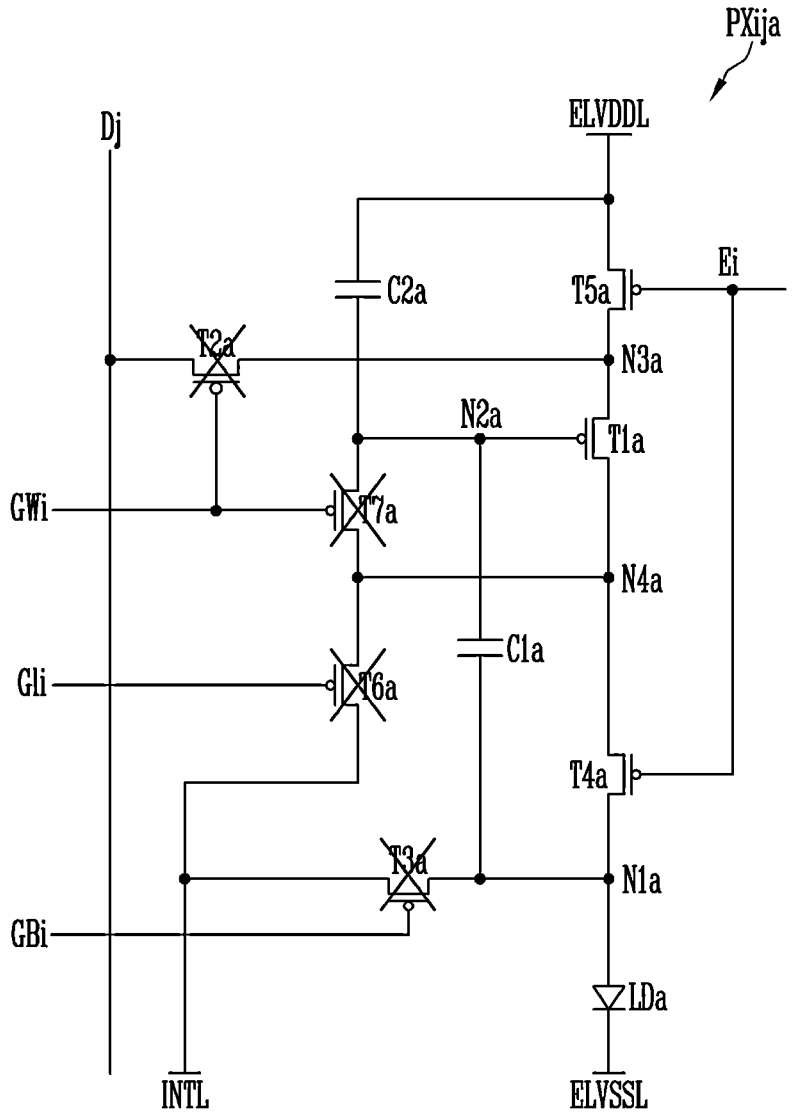

Referring to FIGS. 10 and 11, in a fourth period P14 (e.g., emission period), the first scan signal having the turn-off level may be applied to the first scan line GWi. In this case, the third scan signal having the turn-off level may be applied to the third scan line GIi. In this case, the second scan signal having the turn-off level may be applied to the second scan line GBi. In this case, the emission signal having the turn-on level may be applied to the emission line Ei.

Thus, in the fourth period P14, the transistors T1a, T4a, and T5a may be turned on, and the transistors T2a, T3a, T6a, and T7a may be turned off.

Therefore, a path through which driving current flows in the order of the first power line ELVDDL, the fifth transistor T5a, the first transistor T1a, the fourth transistor T4a, the light emitting diode LDa, and the second power line ELVSSL may be formed. The light emitting diode LDa may emit light depending on the driving current. The fourth period P14 may be referred to as the emission period.

The magnitude of the driving current may be determined according to a voltage difference between the second node N2a and the third node N3a. The voltage of the third node N3a may be substantially the same as the first supply voltage.

$$Ids = \frac{1}{2}(\text{up} \times Cox)\left(\frac{W}{L}\right)(ELVDD - VN2a - Vtrth)^2 \quad \text{[Equation 6]}$$

Here, Ids represents a driving current flowing between the drain electrode and the source electrode of the first transistor T1a, up represents the mobility of the first transistor T1a, Cox represents the capacitance formed by the channel, the insulating layer, and the gate electrode of the first transistor T1a, W represents the width of the channel of the first transistor T1a, L represents the length of the channel of the first transistor T1a, ELVDD represents the first supply voltage, VN2a represents the voltage of the second node N2a, and Vtrth represents the threshold voltage of the first transistor T1a.

With further reference to Equations 4 and 5, Equation 6 may be expressed as Equation 7 below.

$$Ids = \frac{1}{2}(\text{up} \times Cox)\left(\frac{W}{L}\right)\left(ELVDD - DTij - \frac{CC1a}{CC1a + CC2a} * (VINT - (ELVSS + Vldth))\right)^2 \quad \text{[Equation 7]}$$

Since all of the variables and constants of Equation 7 have been described, they will not be repeatedly described.

As the light emitting diode LDa deteriorates, the emission threshold voltage Vldth increases. In other words, in order for the light emitting diode LDa after degradation to emit light at the same luminance as the light emitting diode before degradation, the light emitting diode after degradation requires a larger driving current than the light emitting diode before degradation. Referring to Equation 7, it can be seen that the driving current Ids increases as Vldth increases. If necessary, the amount of increase in the driving current Ids may be adjusted by adjusting the capacitance ratio of the first capacitor C1a and the second capacitor C2a depending on the pixel PXij. Therefore, according to this embodiment, the degradation of the light emitting diode LDa may be compensated by the pixel itself.

Furthermore, the pixel PXija includes two transistors T7a and T6a located in a first leakage current path from the second node N2a to the initialization line INTL. The pixel PXija has the advantage of effectively reducing the first leakage current while maintaining the same number of transistors as a conventional 7T1C pixel (i.e., pixel including seven transistors and one capacitor). When the leakage current is reduced, it is possible to enhance black expression, enable low-frequency driving, and reduce power consumption.

Figure 12:
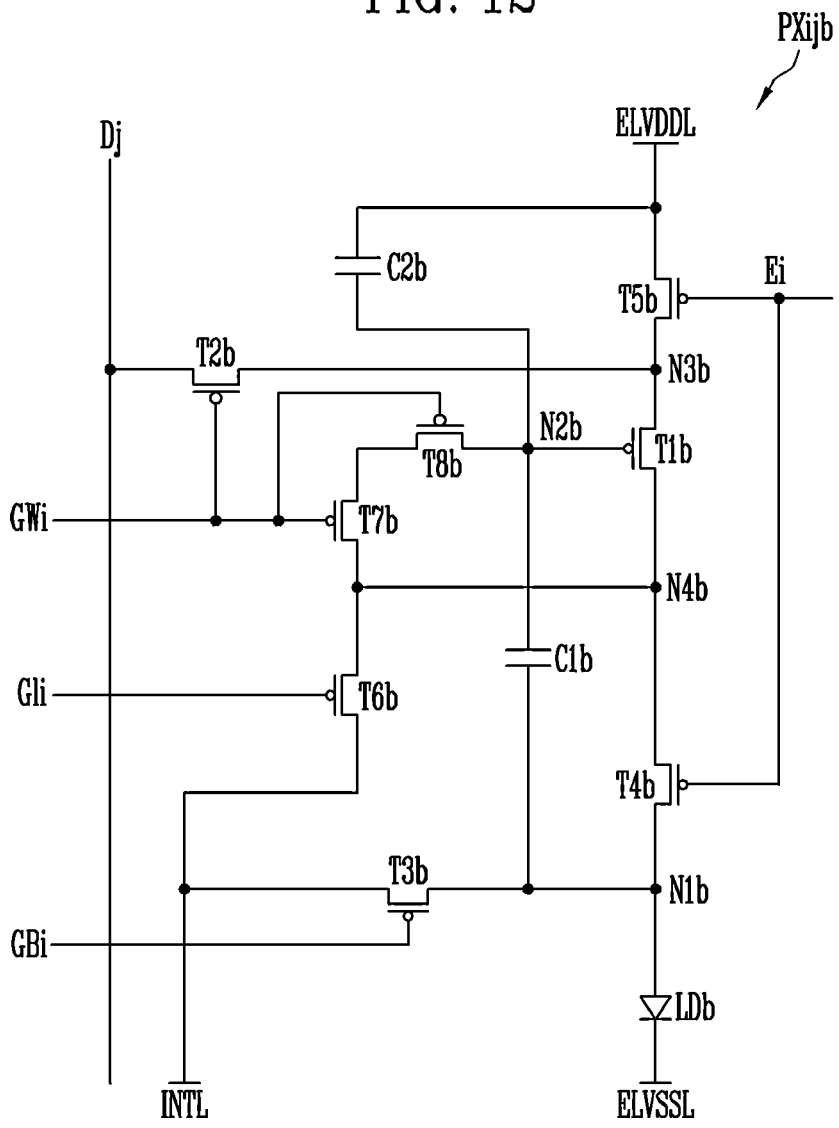
FIG. 12 is a diagram illustrating a pixel according to a second embodiment of the present disclosure.

FIG. 12 is a diagram illustrating a pixel according to a second embodiment of the present disclosure.

Referring to FIG. 12, a pixel PXijb according to the second embodiment of the present disclosure includes transistors T1b, T2b, T3b, T4b, T5b, T6b, T7b, and T8b, capacitors C1b and C2b, and a light emitting diode LDb.

Since the pixel PXijb has substantially the same component as the pixel PXija of FIG. 3 except for the seventh transistor T7b and the eighth transistor T8b, a duplicated description thereof will be omitted.

The seventh transistor T7b may include a gate electrode coupled to the first scan line GWi, a first electrode, and a second electrode coupled to the fourth node N4b.

The eighth transistor T8b may include a gate electrode coupled to the first scan line GWi, a first electrode coupled to the first electrode of the seventh transistor T7b, and a second electrode coupled to the second node N2b.

Since the pixel PXijb includes three transistors T6b, T7b, and T8b located in the first leakage current path from the second node N2b to the initialization line INTL, the first leakage current path can be effectively blocked.

Figure 13:
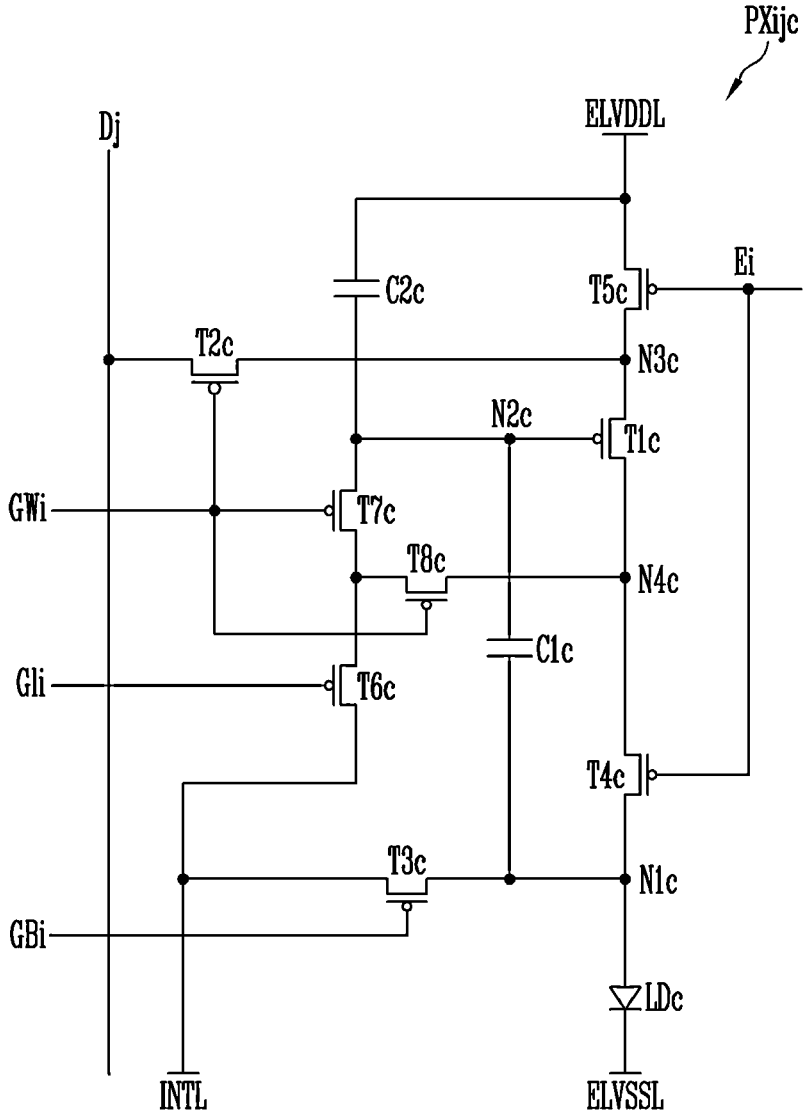
FIG. 13 is a diagram illustrating a pixel according to a third embodiment of the present disclosure.

FIG. 13 is a diagram illustrating a pixel according to a third embodiment of the present disclosure.

Referring to FIG. 13, the pixel PXijc according to the third embodiment of the present disclosure includes transistors T1*c*, T2*c*, T3*c*, T4*c*, T5*c*, T6*c*, T7*c*, and T8*c*, capacitors C1*c* and C2*c*, and a light emitting diode LDc.

Since the pixel PXijc has substantially the same component as the pixel PXija of FIG. 3 except for the sixth transistor T6*c*, the seventh transistor T7*c*, and the eighth transistor T8*c*, a duplicated description thereof will be omitted.

The sixth transistor T6*c* may include a gate electrode coupled to the third scan line GIi, a first electrode, and a second electrode coupled to the initialization line INTL.

The seventh transistor T7*c* may include a gate electrode coupled to the first scan line GWi, a first electrode coupled to the second node N2*c*, and a second electrode coupled to the first electrode of the sixth transistor T6*c*.

The eighth transistor T8*c* may include a gate electrode coupled to the first scan line GWi, a first electrode coupled to the first electrode of the sixth transistor T6*c*, and a second electrode coupled to the fourth node N4*c*.

Since the pixel PXijc includes three transistors T4*c*, T7*c*, and T8*c* located in a second leakage current path from the second node N2*c* to the second power line ELVSSL, the second leakage current path can be effectively blocked.

Figure 14:
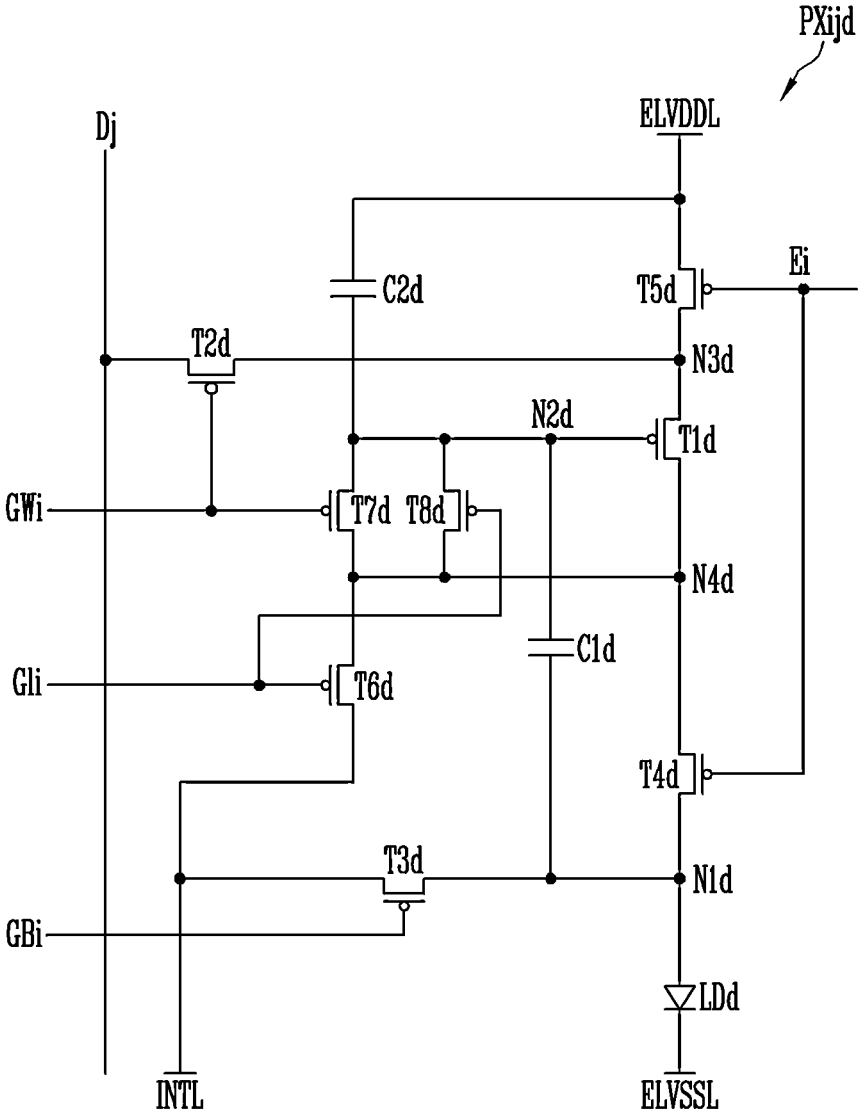
FIG. 14 is a diagram illustrating a pixel according to a fourth embodiment of the present disclosure.
Figure 15:
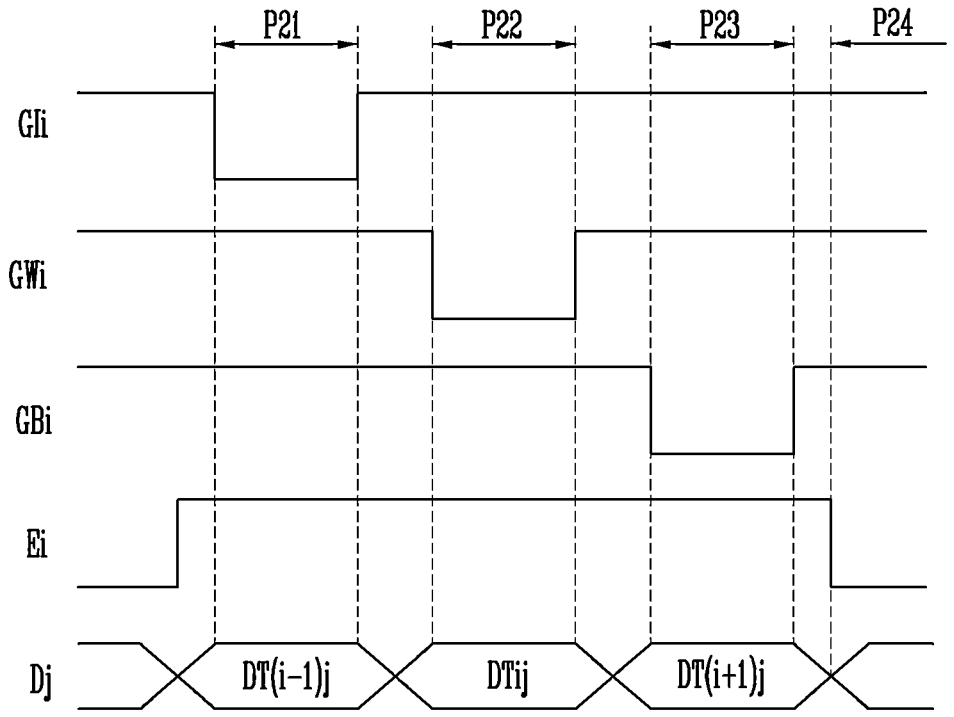
FIG. 15 is a diagram for describing a driving method according to an embodiment of the present disclosure.

FIG. 14 is a diagram illustrating a pixel according to a fourth embodiment of the present disclosure, and FIG. 15 is a diagram for describing a driving method according to an embodiment of the present disclosure.

Referring to FIG. 14, the pixel PXijd according to the fourth embodiment of the present disclosure includes transistors T1*d*, T2*d*, T3*d*, T4*d*, T5*d*, T6*d*, T7*d*, and T8*d*, capacitors C1*d* and C2*d*, and a light emitting diode LDd.

Since the pixel PXijd has substantially the same component as the pixel PXija of FIG. 3 except for the eighth transistor T8*d*, a duplicated description thereof will be omitted.

The eighth transistor T8*d* may include a gate electrode coupled to the third scan line GIi, a first electrode coupled to the second node N2*d*, and a second electrode coupled to the fourth node N4*d*.

The pixel PXijd may be driven according to the driving method of FIG. 15. According to the driving method of FIG. 15, the turn-on level pulses of the first to third scan signals may have the same length and different phases. Therefore, as described above, since the first to third scan drivers 131, 132, and 133 may be integrally formed, an area occupied by the scan driver 13 and construction cost thereof may be reduced.

The driving method of FIG. 15 is substantially the same as the driving method of FIGS. 4 to 11 except that the first scan signal applied to the first scan line GWi has the turn-off level in a first period P21. Therefore, a duplicated description of the driving method of FIG. 15 will be omitted.

For reference, the pixel PXijd may be driven according to the driving method of FIGS. 4 to 11 described above.

Figure 16:
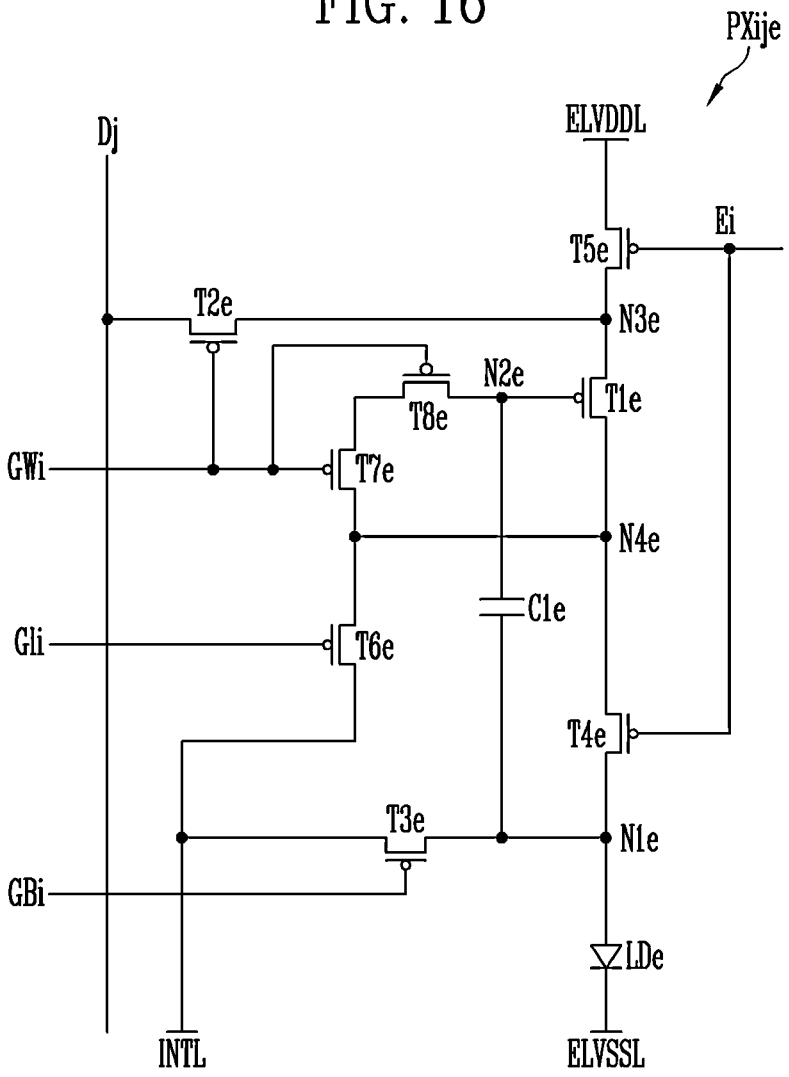
FIG. 16 is a diagram illustrating a pixel according to a fifth embodiment of the present disclosure.

FIG. 16 is a diagram illustrating a pixel according to a fifth embodiment of the present disclosure.

Referring to FIG. 16, the pixel PXije according to the fifth embodiment of the present disclosure includes transistors T1*e*, T2*e*, T3*e*, T4*e*, T5*e*, T6*e*, T7*e*, and T8*e*, a first capacitor C1*e*, and a light emitting diode LDe.

Since the pixel PXije has substantially the same component as the pixel PXija of FIG. 3 except for the seventh transistor T7*e*, the eighth transistor T8*e*, and the capacitor, a duplicated description thereof will be omitted.

The seventh transistor T7*e* may include a gate electrode coupled to the first scan line GWi, a first electrode, and a second electrode coupled to a fourth node N4*e*.

The eighth transistor T8*e* may include a gate electrode coupled to the first scan line GWi, a first electrode coupled to the first electrode of the seventh transistor T7*e*, and a second electrode coupled to the second node N2*e*.

Since the pixel PXije includes three transistors T6*e*, T7*e*, and T8*e* located in a first leakage current path from the second node N2*e* to the initialization line INTL, the first leakage current path can be effectively blocked.

Further, the pixel PXije does not include the second capacitor. The first capacitor C1*e* performs the voltage maintaining function of the second node N2*e*. Thus, because one capacitor may be removed from the existing pixel, the pixel PXije is advantageous in that an area occupied by the pixel PXije may be reduced compared to other embodiments.

Figure 17:
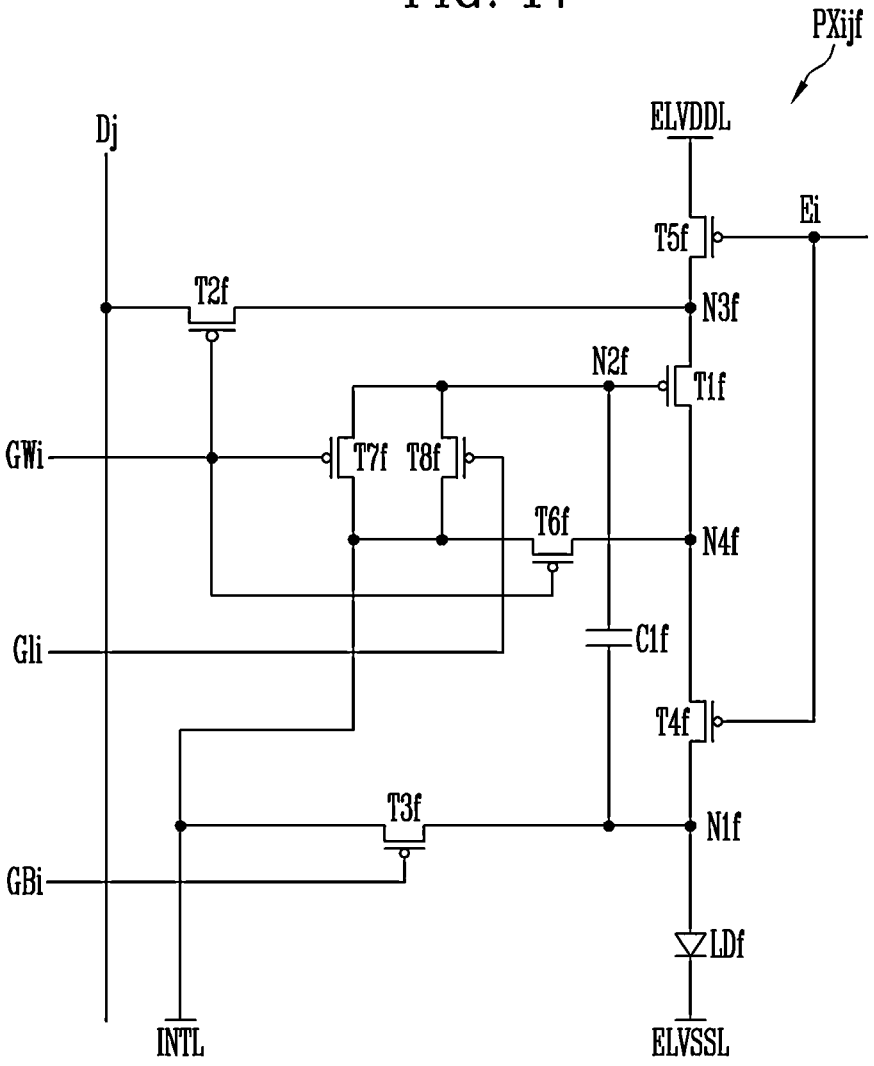
FIG. 17 is a diagram illustrating a pixel according to a sixth embodiment of the present disclosure.

FIG. 17 is a diagram illustrating a pixel according to a sixth embodiment of the present disclosure.

Referring to FIG. 17, the pixel PXijf according to the sixth embodiment of the present disclosure includes transistors T1*f*, T2*f*, T3*f*, T4*f*, T5*f*, T6*f*, T7*f*, and T8*f*, a first capacitor C1*f*, and a light emitting diode LDf.

Since the pixel PXijf has substantially the same component as the pixel PXija of FIG. 3 except for the sixth transistor T6*f*, the seventh transistor T7*f*, the eighth transistor T8*f*, and the capacitor, a duplicated description thereof will be omitted.

The sixth transistor T6*f* may include a gate electrode coupled to the first scan line GWi, a first electrode coupled to the initialization line INTL, and a second electrode coupled to the fourth node N4*f*.

The seventh transistor T7*f* may include a gate electrode coupled to the first scan line GWi, a first electrode coupled to the second node N2*f*, and a second electrode coupled to the initialization line INTL.

The eighth transistor T8*f* may include a gate electrode coupled to the third scan line GIi, a first electrode coupled to the second node N2*f*, and a second electrode coupled to the initialization line INTL.

Since the pixel PXijf includes three transistors T4*f*, T6*f*, T7*f* or T8*f* located in a second leakage current path from the second node N2*f* to the second power line ELVSSL, the second leakage current path can be effectively blocked.

Further, the pixel PXijf does not include the second capacitor. The first capacitor C1*f* performs the voltage maintaining function of the second node N2*f*. Thus, because one capacitor may be removed from the existing pixel, the pixel PXijf is advantageous in that an area occupied by the pixel PXijf may be reduced compared to other embodiments.

Furthermore, the pixel PXijf may be driven according to the driving method of FIG. 15. According to the driving method of FIG. 15, turn-on level pulses of the first to third scan signals may have the same length and different phases. Therefore, as described above, since the first to third scan drivers 131, 132, and 133 may be integrally formed, an area occupied by the scan driver 13 and construction cost thereof may be reduced.

Figure 18:
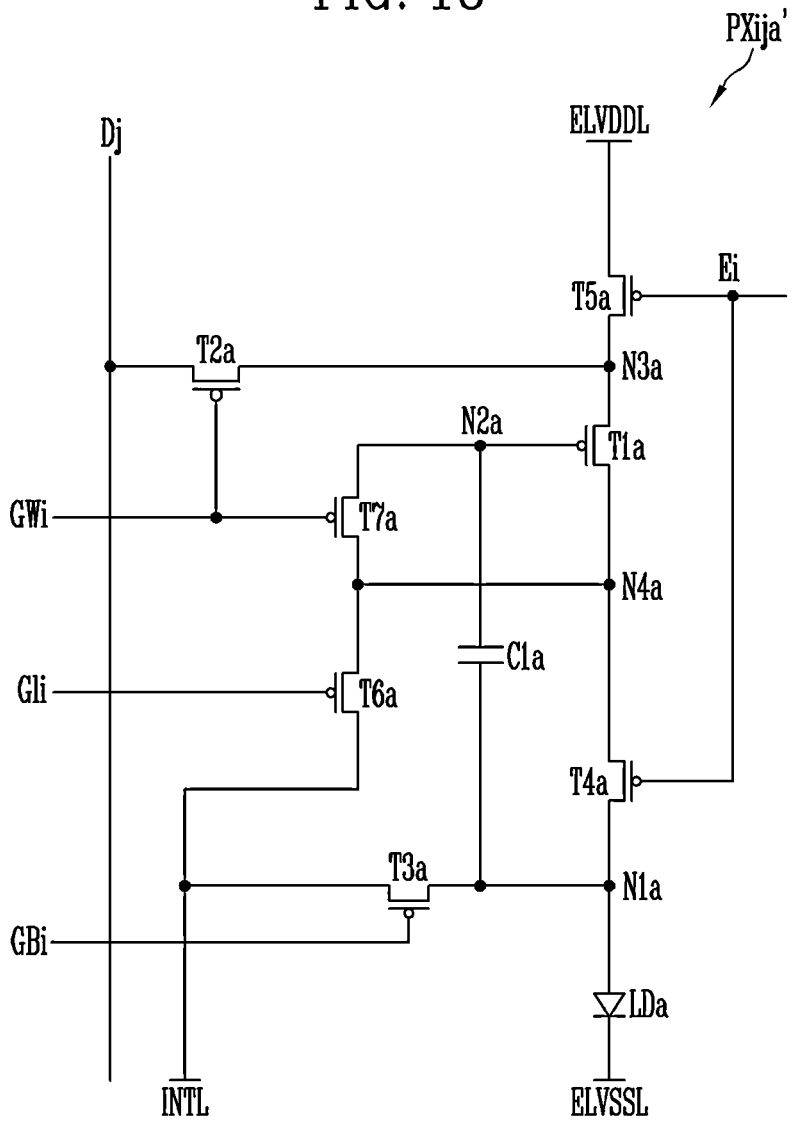
FIG. 18 is a diagram illustrating a pixel according to a seventh embodiment of the present disclosure.

FIG. 18 is a diagram illustrating a pixel according to a seventh embodiment of the present disclosure.

A pixel PXija' of FIG. 18 is shaped such that the second capacitor C2*a* is excluded from the pixel PXija of FIG. 3.

Even if the pixel PXija' does not include the second capacitor, the first capacitor C1*a* performs the voltage maintaining function of the second node N2*a*. Thus, because one capacitor may be removed from the existing pixel, the pixel PXija' is advantageous in that an area occupied by the pixel PXija' may be reduced compared to other embodiments.

Figure 19:
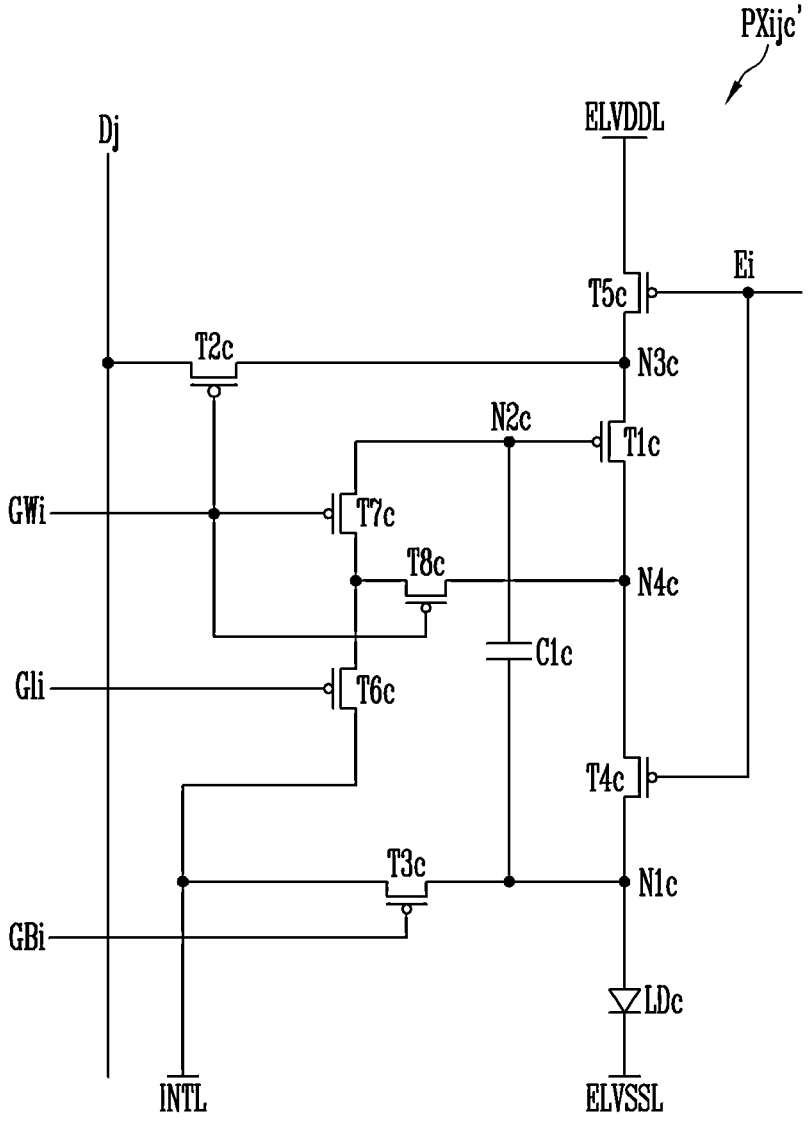
FIG. 19 is a diagram illustrating a pixel according to an eighth embodiment of the present disclosure.

FIG. 19 is a diagram illustrating a pixel according to an eighth embodiment of the present disclosure.

A pixel PXijc' of FIG. 19 is shaped such that the second capacitor C2*c* is excluded from the pixel PXijc of FIG. 13.

Even if the pixel PXijc' does not include the second capacitor, the first capacitor C1*c* performs the voltage maintaining function of the second node N2*c*. Thus, because one capacitor may be removed from the existing pixel, the pixel PXijc' is advantageous in that an area occupied by the pixel PXijc' may be reduced compared to other embodiments.

Figure 20:
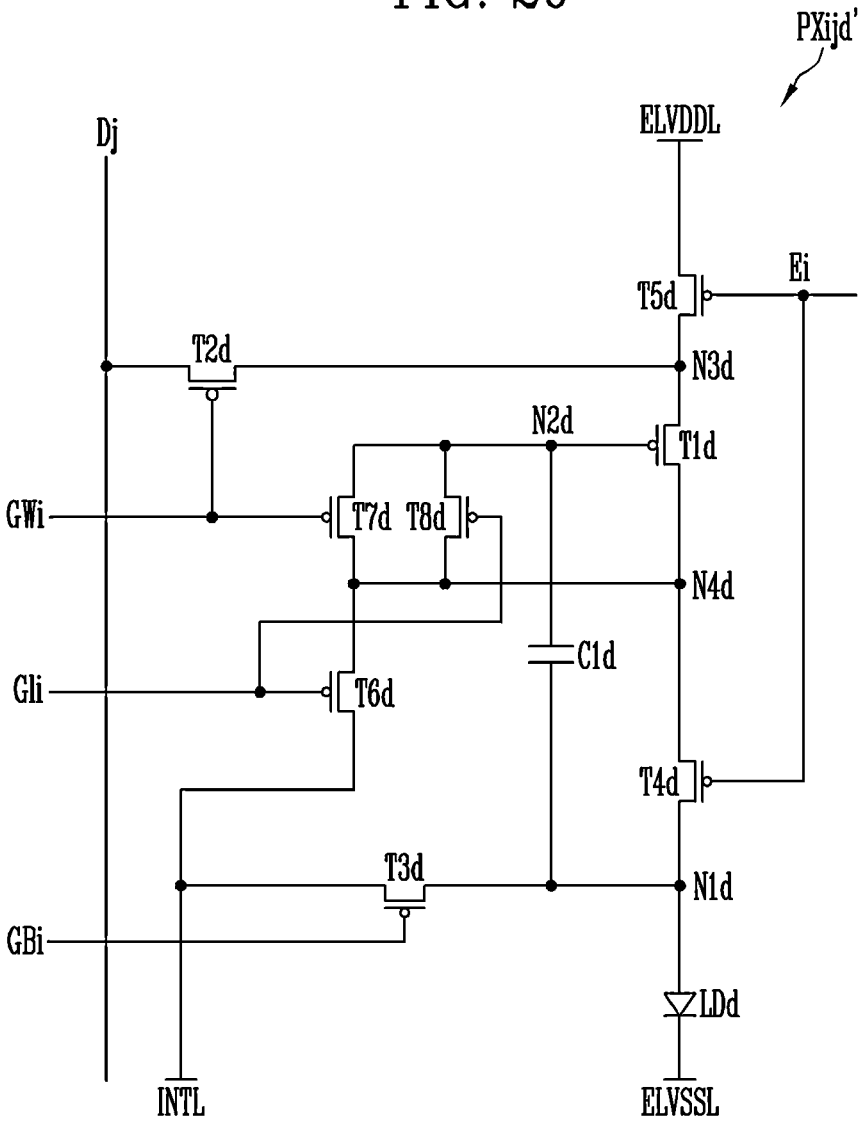
FIG. 20 is a diagram illustrating a pixel according to a ninth embodiment of the present disclosure.

FIG. 20 is a diagram illustrating a pixel according to a ninth embodiment of the present disclosure.

A pixel PXijd' of FIG. 20 is shaped such that the second capacitor C2*d* is excluded from the pixel PXijd of FIG. 14.

Even if the pixel PXijd' does not include the second capacitor, the first capacitor C1*d* performs the voltage maintaining function of the second node N2*d*. Thus, because one capacitor may be removed from the existing pixel, the pixel PXijd' is advantageous in that an area occupied by the pixel PXijd' may be reduced compared to other embodiments.

Figure 21:
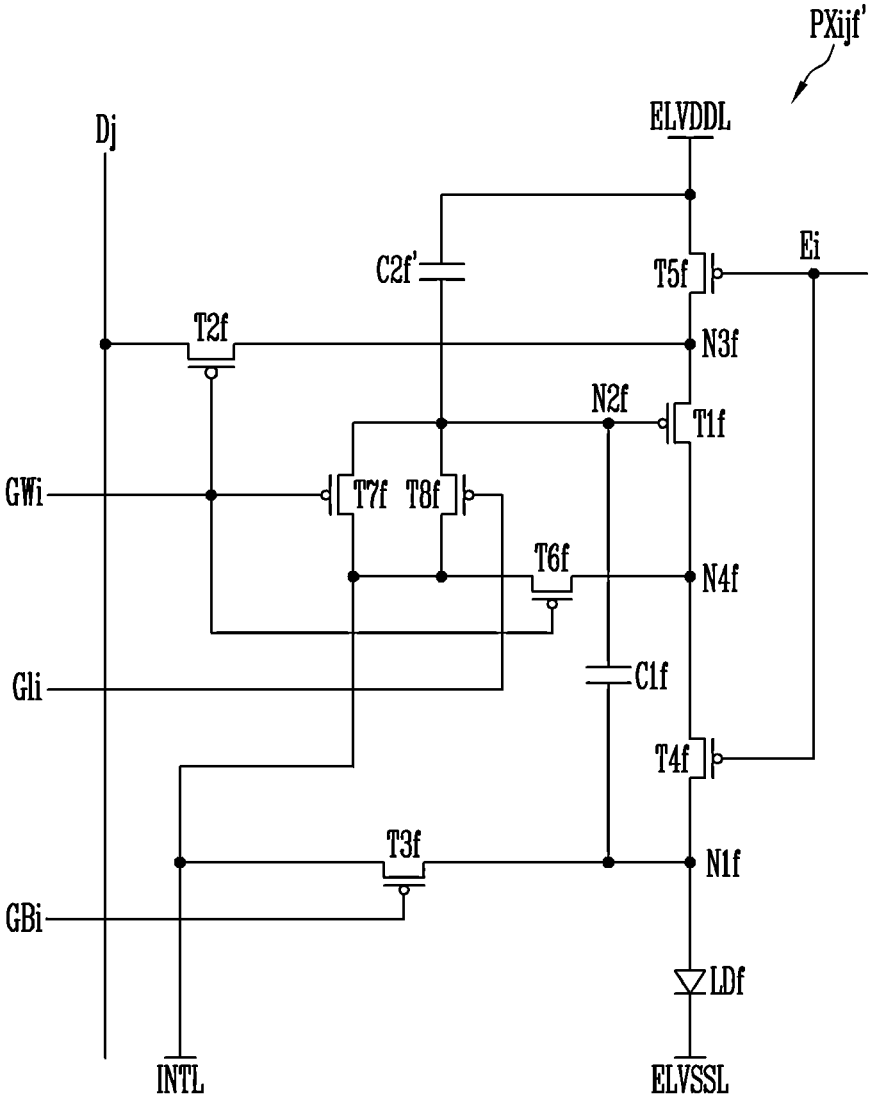
FIG. 21 is a diagram illustrating a pixel according to a tenth embodiment of the present disclosure.

FIG. 21 is a diagram illustrating a pixel according to a tenth embodiment of the present disclosure.

The pixel PXijf' of FIG. 21 is shaped such that a second capacitor C2*f'* is added to the pixel PXijf of FIG. 17.

When comparing a case where the second capacitor C2*f'* is added with a case where only the first capacitor C1*f* is provided, the former can more firmly (without distortion) maintain the compensation voltage of the second node N2*f* recorded in the threshold voltage compensation period.

The detailed description of the disclosure described with reference to the drawings is merely illustrative, which is used only for the purpose of describing the disclosure and is not used to limit the meaning or scope of the disclosure as defined in the accompanying claims. Therefore, those skilled in the art will understand that various modifications and equivalents thereof are possible. Accordingly, the bounds and scope of the present disclosure should be determined by the technical spirit of the following claims.

The invention claimed is:

1. A driving method of a pixel including a light emitting diode including an anode coupled to a first node, a first capacitor including a first electrode coupled to the first node, and a second electrode coupled to a second node, a first transistor including a gate electrode coupled to the second node, a first electrode coupled to a third node, and a second electrode coupled to a fourth node, a second transistor including a gate electrode coupled to a first scan line, a first electrode coupled to a data line, and a second electrode coupled to the third node, a third transistor including a gate electrode coupled to a second scan line, a first electrode coupled to an initialization line, and a second electrode coupled to the first node, a fourth transistor including a gate electrode coupled to an emission line, a first electrode coupled to the fourth node, and a second electrode coupled to the first node; and a fifth transistor including a gate electrode coupled to the emission line, a first electrode coupled to a first power line, and a second electrode coupled to the third node, the method comprises:

electrically connecting the second node to the initialization line, and turning on the second transistor;

electrically disconnecting the second node from the initialization line in a state in which the second transistor is turned on;

turning off the second transistor; and electrically connecting the first node to the initialization line in a state in which the second transistor is turned off.

2. The driving method according to claim 1, wherein:

in the electrical connecting of the first node to the initialization line, the third transistor is turned on.

3. The driving method according to claim 2, further comprising:

turning off the third transistor; and turning on the fourth transistor and the fifth transistor in a state in which the third transistor is turned off.

4. A driving method of a pixel including a light emitting diode including an anode coupled to a first node, a first capacitor including a first electrode coupled to the first node, and a second electrode coupled to a second node, a first transistor including a gate electrode coupled to the second node, a first electrode coupled to a third node, and a second electrode coupled to a fourth node, a second transistor including a gate electrode coupled to a first scan line, a first electrode coupled to a data line, and a second electrode coupled to the third node, a third transistor including a gate electrode coupled to a second scan line, a first electrode coupled to an initialization line, and a second electrode coupled to the first node, a fourth transistor including a gate electrode coupled to an emission line, a first electrode coupled to the fourth node, and a second electrode coupled to the first node; and a fifth transistor including a gate electrode coupled to the emission line, a first electrode coupled to a first power line, and a second electrode coupled to the third node, the method comprises:

electrically connecting the second node to the initialization line in a state in which the second transistor is turned off;

electrically disconnecting the second node from the initialization line;

turning on the second transistor in a state in which the second node is electrically disconnected from the initialization line;

turning off the second transistor; and electrically connecting the first node to the initialization line in a state in which the second transistor is turned off.

5. The driving method according to claim 4, wherein:

in the electrical connecting of the first node to the initialization line, the third transistor is turned on.

6. The driving method according to claim 5, further comprising:

turning off the third transistor; and turning on the fourth transistor and the fifth transistor in a state in which the third transistor is turned off.

7. A pixel, comprising:

a light emitting diode including an anode directly coupled to a first node;

a first capacitor including a first electrode directly coupled to the first node, and a second electrode coupled to a second node;

a first transistor including a gate electrode coupled to the second node, a first electrode coupled to a third node, and a second electrode coupled to a fourth node; and a second transistor including a gate electrode coupled to a first scan line, a first electrode coupled to a data line, and a second electrode coupled to the third node.

8. The pixel according to claim 7, further comprising:

a third transistor including a gate electrode coupled to a second scan line, a first electrode coupled to an initialization line, and a second electrode coupled to the first node.

9. The pixel according to claim 8, further comprising:

a fourth transistor including a gate electrode coupled to an emission line, a first electrode coupled to the fourth node, and a second electrode coupled to the first node.

10. The pixel according to claim 9, further comprising:

a fifth transistor including a gate electrode coupled to the emission line, a first electrode coupled to a first power line, and a second electrode coupled to the third node.

11. The pixel according to claim 10, further comprising:

a sixth transistor including a gate electrode coupled to a third scan line, a first electrode coupled to the fourth node, and a second electrode coupled to the initialization line.

12. The pixel according to claim 11, further comprising:

a seventh transistor including a gate electrode coupled to the first scan line, a first electrode coupled to the second node, and a second electrode coupled to the fourth node.

13. The pixel according to claim 12, further comprising:

an eighth transistor including a gate electrode coupled to the third scan line, a first electrode coupled to the second node, and a second electrode coupled to the fourth node.

14. The pixel according to claim 11, further comprising:

a seventh transistor including a gate electrode coupled to the first scan line, a first electrode, and a second electrode coupled to the fourth node; and an eighth transistor including a gate electrode coupled to the first scan line, a first electrode coupled to the first electrode of the seventh transistor, and a second electrode coupled to the second node.

15. The pixel according to claim 14, further comprising:

a second capacitor including a first electrode coupled to the first power line, and a second electrode coupled to the second node.

16. The pixel according to claim 10, further comprising:

a sixth transistor including a gate electrode coupled to the first scan line, a first electrode coupled to the initialization line, and a second electrode coupled to the fourth node.

17. The pixel according to claim 16, further comprising:

a seventh transistor including a gate electrode coupled to the first scan line, a first electrode coupled to the second node, and a second electrode coupled to the initialization line; and an eighth transistor including a gate electrode coupled to a third scan line, a first electrode coupled to the second node, and a second electrode coupled to the initialization line.

18. The pixel according to claim 10, further comprising:

a sixth transistor including a gate electrode coupled to a third scan line, a first electrode, and a second electrode coupled to the initialization line;

a seventh transistor including a gate electrode coupled to the first scan line, a first electrode coupled to the second node, and a second electrode coupled to the first electrode of the sixth transistor; and an eighth transistor including a gate electrode coupled to the first scan line, a first electrode coupled to the first electrode of the sixth transistor, and a second electrode coupled to the fourth node.

19. The pixel according to claim 18, further comprising:

a second capacitor including a first electrode coupled to the first power line, and a second electrode coupled to the second node.

20. The pixel according to claim 7, further comprising:

a second capacitor including a first electrode coupled to a first power line, and a second electrode coupled to the second node.

* * * * *